US005130913A

United States Patent [19]

David

[11] Patent Number: 5,130,913

[45] Date of Patent: Jul. 14, 1992

[54] LIGHTING DEVICE WITH DICHROIC REFLECTOR

[76] Inventor: Francis David, 28350 Saint Lubin des Joncherets, France

[21] Appl. No.: 699,885

[22] Filed: May 14, 1991

[30] Foreign Application Priority Data

May 15, 1990 [FR] France ..... 90 06026
Apr. 9, 1991 [FR] France ..... 91 04291

[51] Int. Cl.[5] ..... F21V 7/20

[52] U.S. Cl. ..... 362/345; 362/293; 362/297; 362/304; 362/373; 362/294

[58] Field of Search ..... 362/293, 297, 341, 346, 362/345, 304, 373, 294

[56] References Cited

U.S. PATENT DOCUMENTS 3,322,946 5/1967 Cooper ..... 362/345
3,745,325 7/1973 Harvey ..... 362/346
3,769,503 10/1973 Kim ..... 362/280
4,766,526 8/1988 Morimoto et al. ..... 362/293

FOREIGN PATENT DOCUMENTS 7229395 3/1973 France .
7225082 2/1974 France .

*Primary Examiner*—Ira S. Lazarus
*Assistant Examiner*—L. Heyman
*Attorney, Agent, or Firm*—Seidel, Gonda, Lavorgna & Monaco

[57] ABSTRACT

Lighting device comprising a lighting bulb arranged inside a reflector produced from a transparent material and possessing a selective reflecting surface (4) capable of reflecting the visible radiation coming from the bulb (2), while allowing the heat radiation to pass through it, while on the outside of this reflector there is a reflecting surface (6, 8) for the heat radiation passing through the reflector (1), the device being characterized in that the reflecting surface (8) for the heat radiation is formed on a supporting piece arranged outside the reflector.

10 Claims, 2 Drawing Sheets

LIGHTING DEVICE WITH DICHROIC REFLECTOR

Figure 1:
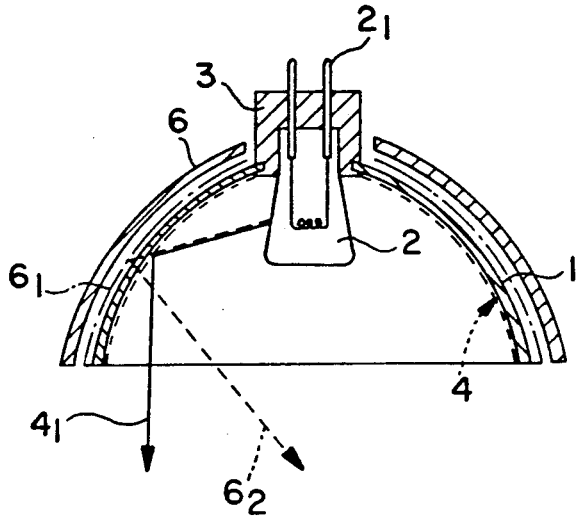

Lighting devices compris a reflector, the geometrical shape of which is defined as a function of the shape of the desired light beam.

These reflectors reflect the entire radiation emitted by the bulb, therefore including the heat radiation, with the result that a distribution curve of the reflected heat radiation which corresponds in form to that of the reflected visible radiation is obtained along the axis of the reflector.

However, this reflection of the heat radiation towards the front of the reflector becomes a serious disadvantage in view of the undesirable thermal effects which it generates on persons, objects or illuminated surfaces.

This disadvantage is particularly noticeable in small-sized reflectors containing miniature bulbs of the halogen type which produce a concentrated light beam of high power.

There are already known lighting devices of the so-called "dichroic reflector" type which are designed to reflect towards the front of the reflector the light radiation coming from the bulb and, on the contrary, to allow the heat radiation to pass through them.

In this case, the outer face of the reflector is of such a structure that it returns the heat radiation towards the interior of the reflector according to a particular distribution curve different from that of the light radiation reflected by the inner face.

The reflecting structure of the outer face of the reflector is obtained by the deposition of a reflecting material, such as a metallization, which thus forms an integral part of the transparent support of the reflecting material for the visible radiation.

Such an embodiment is described for example, in U.S. Pat. No. 3,745,325.

However, it has not been possible for such a lighting device to be developed industrially to any appreciable extent, insofar as the reflecting metallisation for the heat radiation of the outer face of the reflector forms a thermal shield, and therefore heat is absorbed very largely by the transparent supporting material, thereby generating an overheating of the interior of the lighting device, bringing about a premature destruction of the bulb.

This overheating, which is all the greater when the reflector is of small size and the source is of high power, quickly becomes unacceptable and can then cause fires.

The object of the present invention is, in particular, to overcome these disadvantages and to this effect relates to a lighting device comprising a lighting bulb arranged inside a reflector produced from a transparent material an possessing a visible radiation selective reflecting surface capable of reflecting the visible radiation coming from the bulb, whilst allowing the heat radiation to pass through it, whilst on the outside of this reflector there is a heat radiation reflecting surface for the heat radiation passing through the reflector, the device being characterised in that the reflecting surface for the heat radiation is formed on a supporting cup arranged outside the reflector.

According to another characteristic of the invention, the supporting piece is metallic.

According to another characteristic of the invention, the cup is produced in one piece from a plane metal plate, one of the faces of which is equipped with a reflecting covering, this plate subsequently being bent to the shape of the cup.

Figure 2:
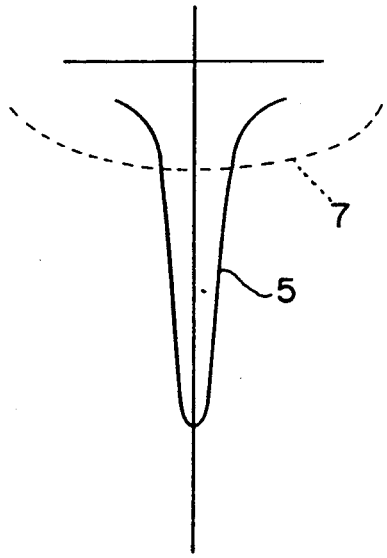
Figure 3:
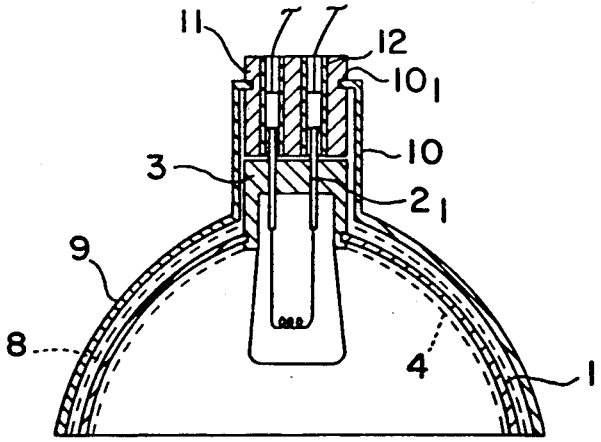
Figure 4:
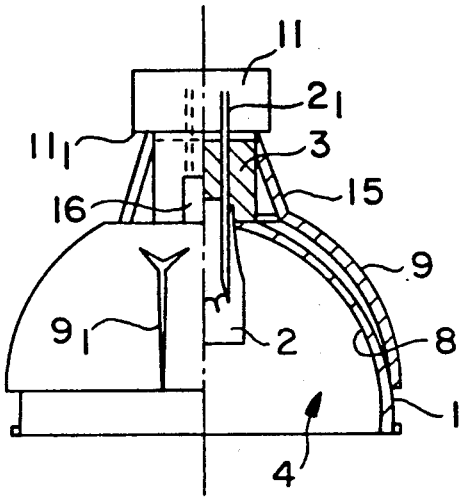
Figure 5:
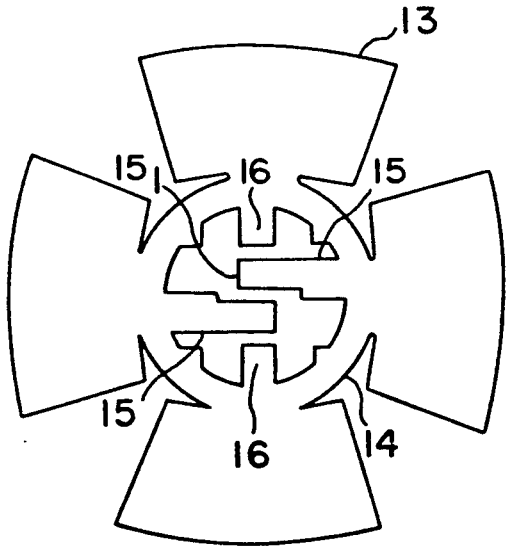

The invention is illustrated by way of non-limiting example in the accompanying drawings in which:

FIG. 1 is a diagrammatic sectional view of a lighting device according to the invention, FIG. 2 shows diagrammatically the distribution of the visible radiation and heat radiation obtained towards the front of the reflector by the lighting device according to the invention, FIG. 3 is a view in axial section of another embodiment of the device of the invention, FIG. 4 is a view in axial half-section of a lighting device according to the invention, FIG. 5 is a laid-flat view of the reflector for the heat radiation provided outside the reflector for visible radiation.

The aim of the present invention is, therefore, to provide a lighting device which makes it possible, in a simple way and at low cost, to prevent overheating of the interior of the lighting device and especially of the bulb which can thus function under normal temperature conditions and therefore without deterioration. This device also makes it possible to reduce the pronounced undesirable thermal effects on articles or persons illuminated by this device, whilst at the same time assisting and making uniform the thermal diffusion on the side of the reflector opposite the illuminated side.

The device illustrated in FIG. 1 thus comprises diagrammatically a reflector 1 and a lighting bulb 2 which is fastened to the base 3 of this reflector at the focal point of the latter. The pins $2_1$ of this bulb project from the base and are intended to be connected to a corresponding plug.

The reflector 1 first of all constitutes a dichroic reflector, insofar as it is produced from transparent material and as it possesses, generally on its inner face, a selective reflecting covering 4 which reflects the visible radiation, but which allows the infrared heat radiation to pass through it.

The visible radiation coming from the bulb is thus reflected towards the front of the reflector in the form of rays $4_1$ and results in a light beam, the distribution curve 5 A (FIG. 2) of which is defined by the shape of the reflecting surface 4 of the reflector 1.

According to the invention, however, on the outer face of the reflector 1 is a supporting piece 6 equipped, on its inner face, with a reflecting surface $6_1$ for the heat radiation, so that this radiation which passes through the dichroic reflector is partially diffused by the support 6 forming a heat exchanger and is partially reflected by this reflecting surface 6 both to pass through the reflector 1 once again and to produce, towards the front of this reflector, reflected rays $6_2$, the direction of which is different from that of the reflected light rays $4_1$. This different direction of the rays $6_2$ occurs as a result of the different position of the surface $6_1$ in relation to the surface 4 in terms of the position of the filament of the bulb 2.

This direction of the rays $6_2$ results in a distribution of the heat radiation 7 (FIG. 2) which is different from that of the visible radiation 5. This distribution curve will thus be spread over a large area in front of and in proximity to the lighting device, so as to avoid undesirable thermal effects on the persons and objects illuminated, whilst of course preventing overheating of the elements located towards the rear of the reflector.

If desired the reflecting surface of the support 6 can be ground in order to increase the diffusion of the reflected visible radiation.

According to the example of FIG. 3, this reflecting surface 8 is produced on the inner face of a cup-shaped supporting piece 9 arranged in the immediate vicinity of the outer face of the reflector 1.

This reflecting surface 8 consists either of a metallization of the inner face of a plastic supporting piece 9 or of the polished or ground reflecting inner face of a piece 9 made of metal. This piece, the shape of which corresponds or does not correspond to that of the dichroic reflector, possesses at its centre an orifice or receptacle of such dimensions that it can receive the base 3 of the dichroic reflector.

In the example illustrated in FIG. 3, the reflecting supporting piece 9 constituting both a thermal shield and a heat exchanger is equipped with an axial connector 10 terminating in an inner ring $10_1$. This ring catches on the plug 11 possessing the female pins 12, onto which engage the male pins $2_1$ of the bulb 2 sealed in the base 3 of the reflector 1. This arrangement makes it possible to replace the bulb 2 and the reflector 1, whilst keeping in the lighting device the reflector 9 which is automatically positioned relative to the bulb 2 and to the reflector 1 during the fitting of this bulb on the plug 11.

According to an alternative embodiment not shown, the tab-shaped axial connector 10 provided with its ring $10_1$ will catch on a clip surrounding the plug 11.

This supporting piece 9, instead of being supported by the plug 11, can also be supported by the base 3 of the reflector 1 or by this reflector.

Insofar as the distribution curve of the reflected heat radiation 7 is to be adapted it would be possible to give the surface 6 or 8 reflecting the heat radiation a curvature different from that of the surface 4 reflecting the light radiation.

The usefulness of the present invention will be found to be that the lighting device is simple and inexpensive to produce and that it is assembled quickly by automatically positioning the outer reflector for the heat radiation on the inner reflector for the visible radiation.

Thus, according to FIGS. 4 and 5, the cup 9 forming a thermal shield and heat exchanger is produced by cutting a plane plate, preferably made of metal, which has been previously covered with a reflecting material on one of its faces. This plane reflecting plate is cut to form radial tongues 13, for example four in number, uniformly distributed on the periphery of a central part 14. These tongues 13 are cut in such a way that the shape of the cup 9 is obtained by bending, the edges of the tongues coming next to one another and against the edge of the central part 14.

According to a particular embodiment, the cutting and bending are carried out so as to form between the tongues narrow slit-shaped orifices which, as are shown at $9_1$in FIG. 1 [sic], are obtained as a result of the non-contiguous assembling of the cut edges. This arrangement will make it possible to assist the cooling of the lamp, making it possible to establish convection currents and benefit the decorative effect.

As a result of this construction of the reflector 9, the cut tongues 13 undergo a bending of relatively small extent which does not change the structure of the reflecting surface, thereby making it possible to use as a starting material a metal plate previously provided with a reflecting surface, in order to reduce the production cost of this reflector considerably.

According to the invention, there is also provision for carrying out the cutting of tongues 15 and 16 within the central zone 14 simultaneously with the cutting of the tongues 13.

These tongues 15 and 16 form two pairs of tongues, the tongues of each pair being parallel and opposed whilst the tongues of one pair are perpendicular to the tongues of the other pair.

Likewise, the tongues 15 of one of the pairs are of such a length that, after bending, they come to bear with their ends $15_1$, if appropriate laterally relative to the base 3, but above all substantially vertically, against the face $11_1$ opposite the base of the connecting plug 11.

In contrast, the other two parallel and opposed tongues 16 are of lesser length and perform the sole function of clamping themselves against the lateral wall of the base 3 effectively as a result of their shorter length, in order to ensure a centring of the cup 9, whereas the main function of the longer tongues 15 is to ensure the axial positioning of the reflector 9 by pushing it axially towards the reflector 1.

I claim:

1. Lighting device comprising a lighting bulb arranged inside a reflector produced from a transparent material and possessing a visible radiation selective reflecting surface capable of reflecting the visible radiation coming from the bulb, whilst allowing the heat radiation to pass through it, whilst on the outside of this reflector there is a heat radiation reflecting surface for the heat radiation passing through the reflector, wherein the reflecting surface for the radiation is formed on a supporting cup arranged outside and in the vicinity of the reflector.

2. Device according to claim 1, wherein the supporting cup is supported by the reflector.

3. Device according to claim 1, wherein the supporting cup is supported by a plug and wherein pins are provided on the bulb, the plug receiving the pins of the bulb and supporting the reflector for the light radiation.

4. Device according to claim 2, wherein the supporting cup is fastened on the reflector for visible radiation.

5. Device according to claim 1, wherein the cup is produced in one piece from a plane metal plate, one of the faces of which is equipped with a reflecting covering, this plate subsequently being bent to the shape of the cup.

6. Device according to claim 5, wherein the plate is cut to form radial tongues which come into the vicinity of one another as a result of the bending operation.

7. Device according to claim 6, wherein the metal plate is cut to form radial tongues distributed externally to the periphery of a central zone itself equipped internally with cut-out tongues.

8. Device according to claim 7, wherein the tongues cut out within the central zone are of such a length that they come to bear with their end on the base surface of the junction plug receiving the pins of the bulb provided on the reflector for visible radiation.

9. Device according to claim 8, wherein the tongues cut out within the central zone comprise a pair of opposite parallel tongues which have such a length that they come to bear with their ends on the base surface of the junction plug, and a pair of opposite parallel tongues perpendicular to the preceding ones and of shorter length so as to be laid solely against the foot of the reflector.

10. Device according to claim 5, wherein the plane plate is metallic.

* * * * *